US009302310B2

(12) United States Patent
Kiridena et al.

(10) Patent No.: US 9,302,310 B2
(45) Date of Patent: Apr. 5, 2016

(54) COMPOSITE DIES AND METHOD OF MAKING THE SAME

(71) Applicant: Ford Global Technologies, LLC, Dearborn, MI (US)

(72) Inventors: Vijitha Senaka Kiridena, Ann Arbor, MI (US); Zhiyong Cedric Xia, Canton, MI (US); Matthew John Zaluzec, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 190 days.

(21) Appl. No.: 14/219,445

(22) Filed: Mar. 19, 2014

(65) Prior Publication Data

US 2015/0266079 A1 Sep. 24, 2015

(51) Int. Cl.

| | |
|---|---|
| ***B21K 5/20*** | (2006.01) |
| ***B21D 37/01*** | (2006.01) |
| ***B21D 37/16*** | (2006.01) |

(52) U.S. Cl.
CPC ..... *B21D 37/01* (2013.01); *B21D 37/16* (2013.01)

(58) Field of Classification Search
CPC ..... B21D 37/01; B21D 22/10; B21D 37/16
USPC ..... 72/476; 76/107.1
See application file for complete search history.

(56) References Cited

U.S. PATENT DOCUMENTS

| | | | | |
|---|---|---|---|---|
| 2,887,971 | A * | 5/1959 | Kalis | B21D 37/20 428/414 |
| 3,343,430 | A * | 9/1967 | Haas | B21D 37/20 76/107.1 |
| 3,533,271 | A * | 10/1970 | Adgate | B21D 37/20 72/476 |
| 3,860,803 | A | 1/1975 | Levine | |
| 4,527,729 | A | 7/1985 | Inoue | |
| 5,094,796 | A * | 3/1992 | Katoh | B29C 33/42 100/211 |
| 5,223,051 | A * | 6/1993 | Ryntz, Jr. | B22D 31/002 148/538 |
| 5,566,594 | A | 10/1996 | Michlin | |
| 5,638,724 | A * | 6/1997 | Sanders | B21D 26/055 72/60 |
| 5,793,015 | A | 8/1998 | Walczyk | |
| 6,279,425 | B1 * | 8/2001 | Cicotte | B21D 37/20 72/709 |
| 6,474,196 | B2 | 11/2002 | Watanabe et al. | |
| 6,517,773 | B1 | 2/2003 | Mitchell et al. | |
| 6,560,499 | B1 | 5/2003 | Demmer | |

(Continued)

FOREIGN PATENT DOCUMENTS

| | | |
|---|---|---|
| CN | 101920440 | 12/2010 |
| EP | 0101671 | 2/1984 |

OTHER PUBLICATIONS

COMECstampi, COMEC Manufacturing of Sheet Metal Dies and Mechanical Equipments, 2 pages, Jul. 25, 2013, www.comecstampi.com.

(Continued)

*Primary Examiner* — David B Jones
(74) *Attorney, Agent, or Firm* — Damian Porcari; Law Firm of Dr. Junqi Hang, PLC

(57) ABSTRACT

In one or more embodiments, a composite die includes a die face defining a protrusion and including a first metal, and a die base supporting the die face, the die base including a housing, a first filler positioned within the housing and contacting the protrusion, and a bridging member reinforcing the housing, the housing including a second metal different than the first metal.

18 Claims, 7 Drawing Sheets

(56) References Cited

U.S. PATENT DOCUMENTS

| | | | | |
|---|---|---|---|---|
| 6,884,966 | B2 * | 4/2005 | Coleman | B21D 26/055 148/698 |
| 7,712,396 | B2 | 5/2010 | Holmquist et al. | |
| 8,322,176 | B2 | 12/2012 | Johnson et al. | |
| 2012/0011915 | A1 | 1/2012 | Kiridena et al. | |
| 2015/0266079 | A1 * | 9/2015 | Kiridena | B21D 37/01 72/476 |

OTHER PUBLICATIONS

Allwood et al., A Novel Method for the Rapid Production of Inexpensive Dies and Moulds with Surfaces made by Incremental Sheet Forming, Oct. 25, 2005, J. Engineering Manufacture, pp. 323-327.

* cited by examiner

COMPOSITE DIES AND METHOD OF MAKING THE SAME

TECHNICAL FIELD

The disclosed inventive concept relates generally to composite dies and method of making the same.

BACKGROUND

Sheet metal forming process has been used in various industries, including those for automotive and aerospace products, medical equipments, consumer appliances and beverage containers. Traditional sheet metal forming processes often utilize a set of dies under mechanical force to impart onto a sheet metal a three-dimensional (3D) shape. For certain high volume productions, dies may be made from cast irons or cast steels for strength and durability. To make certain low volume of sheet metal parts such as prototypes, kirksite dies or zinc dies are often used to save cost. However, kirksite or zinc dies may still need to be engineered, cast, machined and assembled. These treatments remain expensive; yet low volume productions are still needed to make certain small volumes of sheet metal parts.

SUMMARY

In one or more embodiments, a composite die includes a die face defining a protrusion and including a first metal, and a die base supporting the die face, the die base including a housing, a first filler positioned within the housing and supporting the protrusion, and a bridging member reinforcing the housing, the housing including a second metal different than the first metal. In certain instances, the first filler may directly contact the protrusion.

The die base may further include a second filler different from the first filler. The first filler may be different in composition than the die face or the housing. The first filler may include a third metal different than the first or the second metal.

The composite die may further include a heat-conductive piping unit contacting the die base. The heat-conductive piping unit may include a formal piping portion conforming to a corresponding shape of at least one of the die face and the die base.

The protrusion may include first and second protrusions spaced apart from each other. The first protrusion may protrude in a first direction and the second protrusion may protrude in a second direction different from the first direction. In certain instance, the first protrusion is of a concave shape and protrudes toward the housing, and the second protrusion is of a convex shape and protrudes away from the housing.

The housing may include a number of side walls and a floor joined to the number of side walls. At least two of the number of side walls may differ from each other in dimension.

In another or more embodiments, a composite die includes a die face defining a protrusion, a die base supporting the die face, the die base including a housing, a filler positioned within the housing and contacting the protrusion, and a heat-conductive piping unit contacting the die base.

In yet another or more embodiments, a composite die includes a die face includes a three-dimensional free form and defining first and second protrusions, a die base supporting the die face, the die base including a housing, a first filler contacting the housing and the first protrusion, a second filler supporting the housing and the second protrusion, and a bridging member reinforcing the housing, and a heat-conductive piping unit supporting the die base and including a conformal piping portion conforming to a corresponding shape of at least one of the die face and the die base.

The above advantages and other advantages and features will be readily apparent from the following detailed description of embodiments when taken in connection with the accompanying drawings.

BRIEF DESCRIPTION OF THE DRAWINGS

For a more complete understanding of embodiments of this invention, reference should now be made to the embodiments illustrated in greater detail in the accompanying drawings and described below by way of examples wherein.

DETAILED DESCRIPTION OF ONE OR MORE EMBODIMENTS

Figure 1A:
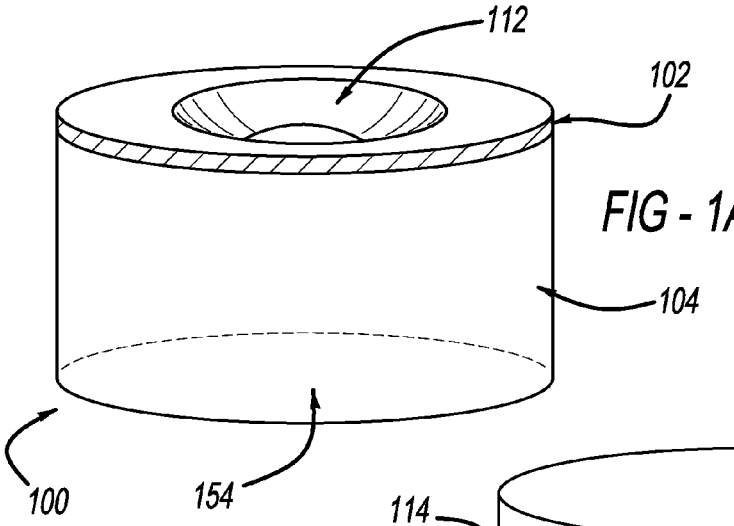
FIG. 1A illustratively depicts a composite die according to one or more embodiments of the present invention.

As referenced in the FIG.s, the same reference numerals are used to refer to the same components. In the following description, various operating parameters and components are described for different constructed embodiments. These specific parameters and components are included as examples and are not meant to be limiting.

The disclosed inventive concept is believed to have overcome one or more of the problems associated with known production of metal dies for relatively low volume productions. In particular, the metal dies according to the present invention in one or more embodiments may be formed without the need for casting or surface machining, which can be cost prohibitive and time consuming for the volume of productions involved.

The present invention in one or more embodiments provides a composite die using incrementally formed functional face as the die surface and bonded with supporting structure. The composite die thus provided is believed to be provided with relatively high process flexibility, high energy-efficiency, relatively low capital investment, relatively high time efficiency, and/or with the elimination of the need for massive die casting and machining.

Figure 1B:
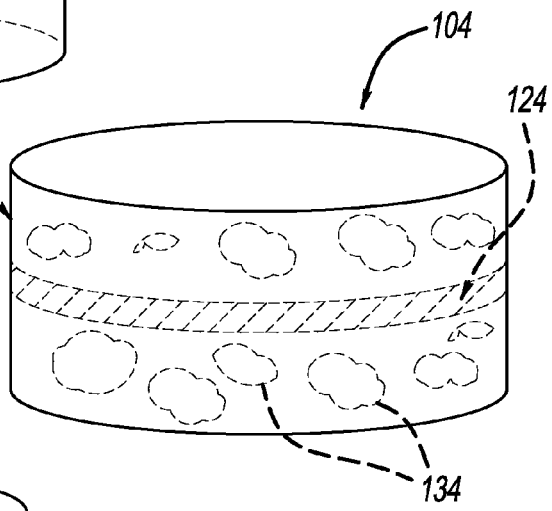
FIG. 1B illustratively depicts a partial view of the composite die referenced in FIG. 1A.
Figure 1C:
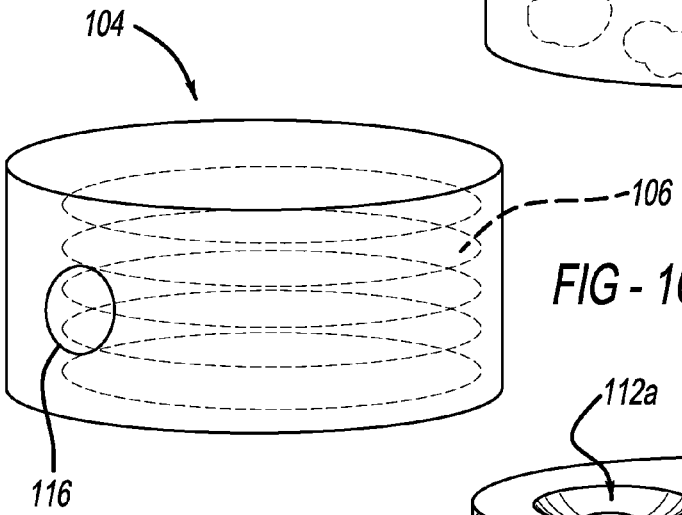
FIG. 1C illustratively depicts another partial view of the composite die referenced in FIG. 1A.

In one or more embodiments, and as illustratively depicted in FIGS. 1A through 1C (or FIGS. 2A through 2C), a composite die 100 (or 200) includes a die face 102 (or 202) defining a protrusion 112 (or 212) and including a first metal, and a die base 104 (or 204) supporting the die face 102 (or 202), the die base 104 (or 204) including a housing 114 (or 214), a first filler 134 (or 234) positioned within the housing 114 (or 214) and supporting the protrusion 112 (or 212), and a bridging member 124 (or 224) reinforcing the housing 114 (or 214), the housing 114 (or 214) including a second metal different than the first metal.

Figure 2A:
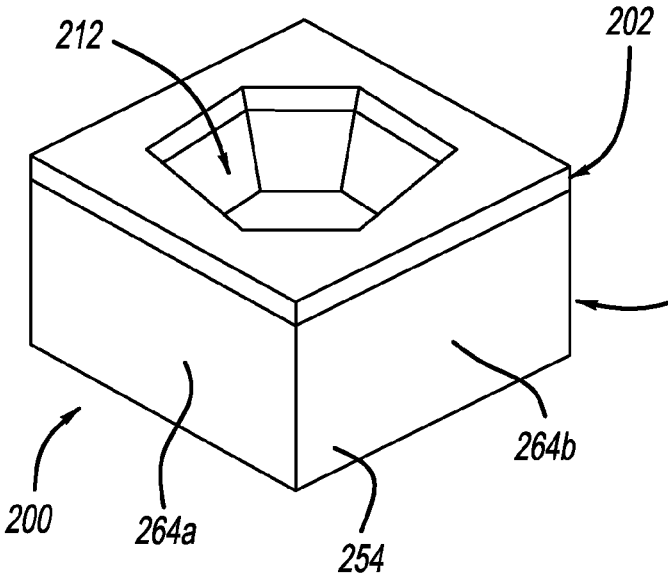
FIG. 2A illustratively depicts a composite die according to another or more embodiments of the present invention.

A demonstrable difference between the composite die 100 referenced in FIG. 1A and the composite die 200 referenced in FIG. 2A includes a difference in an overall shape. By way of example, the composite die 100 referenced in FIG. 1A has a general cross-sectional shape of a circle or an oval. Similarly, the composite die 200 referenced in FIG. 2A has a general cross-sectional shape of a square or a rectangle. The overall shapes of the composite die 100, 200 as depicted in FIG. 1A and FIG. 2A are only depicted so for illustration purposes and they can be of any suitable geometrically regular or irregular shapes.

According to one or more embodiments of the present invention, the term "composite" as used in representing the composite die 100 (or 200) refers to a structure where the die face 102 (or 202) and the die base 104 (or 204) are each made separately, and subsequently joined together to form the composite die 100 (or 200). Therefore, the composite die 100 (or 200) presents a departure in its structure or forming method from certain existing die designs formed out of integral solids. In this connection, and as mentioned herein elsewhere, the present invention in one or more embodiments is advantageous in providing relatively enhanced design and manufacture flexibility. For instance, the composition of the filler materials may be customized dependent upon a particular project need at hand to provide for strategic placement of the filler materials within the die base and hence strength optimization of the resulting composite die.

The composite die 100 (or 200) may be used in connection with another composite die having matching surface shapes such that a blank may be positioned between the two matching composite dies to be formed for a desired shape. In this connection, the composite die 100 (or 200) may be considered as a male or female matching half of a die set.

Figure 1D:
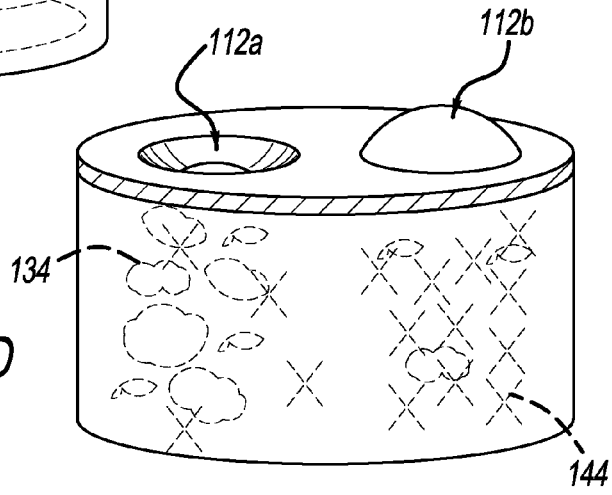
FIG. 1D illustratively depicts another view of the composite die referenced in FIG. 1A.

Although the composite die 100 (or 200) is only depicted with a singly positioned protrusion 112 (or 212), the number and the shape of the protrusion 112 (or 212) may vary dependent upon the desirable shape to be imparted onto the blank. By way of example, and as illustratively depicted in FIG. 1D, the protrusion 112 may include a first protrusion 112*a* and a second protrusion 112*b*, which may be spaced apart from each other to impart a particular three-dimensional shape to a resulting work piece from the blank. It is also possible that the first and second protrusions 112*a*, 112*b* each protrude in different directions. By way of example, and as illustratively depicted in FIG. 1D, the first protrusion 112*a* may protrude in a first direction such as a direction of being toward the housing 114 or a floor 154 of the housing 114, and the second protrusion 112*b* may protrude in a second direction different from the first direction such as a direction of being away from the housing 114 or a floor 154 of the housing 114.

The housing 114 (or 214) may be configured to define a cavity through which the protrusion 112 of the die face 102 may be received. To impart the die face 102 with a desirable level of durability, the first filler 134 (or 234) and/or the bridging member 124 (or 224) are introduced into the housing 114 (or 214) to provide structural reinforcement.

The present invention in one or more embodiments is advantageous in that the housing 114 (or 214) may be constructed from a material that is relatively cheap and/or easy to work with. The die face 102 (or 202) may differ from the housing 114 (or 214) in metal composition. In particular, the die face 102 (or 202) may be formed from a metal that is relatively more precious to accommodate certain stamping needs. However, because only the die face 102 (or 202) of the composite die 100 (or 200) needs to include or be formed of this relatively precious metal and not the entire volume of the composite die 100 (or 200), the resulting composited die 100 (or 200) may be provided with relatively greater design flexibility and greater cost benefits.

Referring back to FIG. 1D, the die base 104 may further include a second filler 144 optionally different from the first filler 134. This design may be particularly useful in accommodating the variable reinforcement requirements particular to the first and second protrusions 112*a*, 112*b*. In this connection, and as mentioned herein elsewhere, the first filler 134 may be a material of certain texture and strength suitable for the particular shape imparted by the first protrusion 112*a*. Likewise, the second filler 144 may be a material of certain texture and strength suitable for the particular shape imparted by the second protrusion 112*b*. Therefore, this configuration accommodates placement within the die base variable combination of filler materials and provides the design freedom for strength and/or stiffness requirements. In any event, both the first and second fillers 134, 144 may be of any suitable material in composition, with non-limiting examples thereof including polymers, cement, glass, fabrics, metals or metallic alloys. In the event that a metal is included in the first and/or second fillers 134, 144, the metal may be different than that included in the die face 102 (or 202) and/or the housing 114 (or 214).

Referring back to FIG. 1C and FIG. 2C, the composite die 100 (or 200) may further include a heat-conductive piping unit 116 (or 216) contacting the die base 104 (or 204). The heat-conductive piping unit 106 (or 206) helps provide heating or cooling, and particularly cooling, to the die face 102 (or 202) during an active stamping process to add or remove heat energy. The present invention in one or embodiments is advantageous in that heating or cooling to the composite die 100 (or 200) may be provided in areas otherwise difficult to reach via conventional piping via gun-drilling. Here and illustratively depicted in FIG. 1C and FIG. 2C, the piping unit 106 (or 206) may include turns such as a conformal piping portion 116 shown in FIG. 1C that conforms to a corresponding shape of at least one of the die face 102 and the die base 104 to provide relatively enhanced geometrical conforming of the cooling unit within the die base. Such conformal piping structure may not be realistically possible in certain conventional dies made of metal solids where holes or pipes may need to be gun-drilled and the resultant piping structures are limited in shape and complexity. This configuration may be particularly useful in situations where cooling is desirable, such as warm forming, hot stamping, and/or injection molding.

The heat-conductive piping unit 106 (or 206) may be constructed beforehand using any suitable piping forming technologies and subsequently placed within the housing 114 (or 214). The heat-conductive piping unit 106 may include pipes of any shapes or dimensions, which may be connected or spaced apart from each other. The heat-conductive piping unit 106 may take the general interior shape of the housing 114 (or 214) such as a spiral conforming unit depicted in FIG. 1C and FIG. 2C.

Although the composite die 100 (or 200) is depicted with the housing 114 (or 214), the housing is not necessarily needed. This is practical when, for instance, contents forming the die base can be cured and hardened and thereafter become the die base without the need for a housing. However, in the event a housing is employed, the housing 114 (or 214) may be formed out of a continuous sheet of material to arrive at a cylindrical shape such as that depicted in FIG. 1A. Alternatively, the housing 114 (or 214) may be formed from a number of side walls 264*a*, 264*b* and a floor 254 (or 154) joined to the number of side walls. When as needed, any two of the number of side walls such as the side walls 264*a*, 264*b* may differ from each other in dimension. This may be useful to accommodate the particular shape and design imparted by the die face 102 (or 202).

In view of FIG. 4, FIGS. 3A through 3I show a non-limiting process 400 by which the composite die 200 may be formed. At step 402 and in view of FIG. 3A, a high hardness, high wear resistant sheet metal blank is incrementally formed to produce a die face geometry, with specified form tolerances and surface finish. Optional steps can be taken to further heat-treat the formed die face to enhance its hardness or other performance attributes as needed.

Figure 3A:
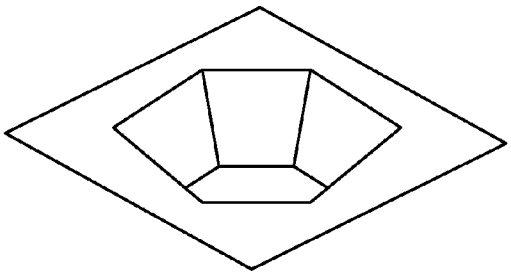
FIGS. 3A to 3I illustratively depict various views of a non-limiting process of making the composite die referenced in FIG. 2A, FIG. 2B and/or FIG. 2C.
Figure 3B:
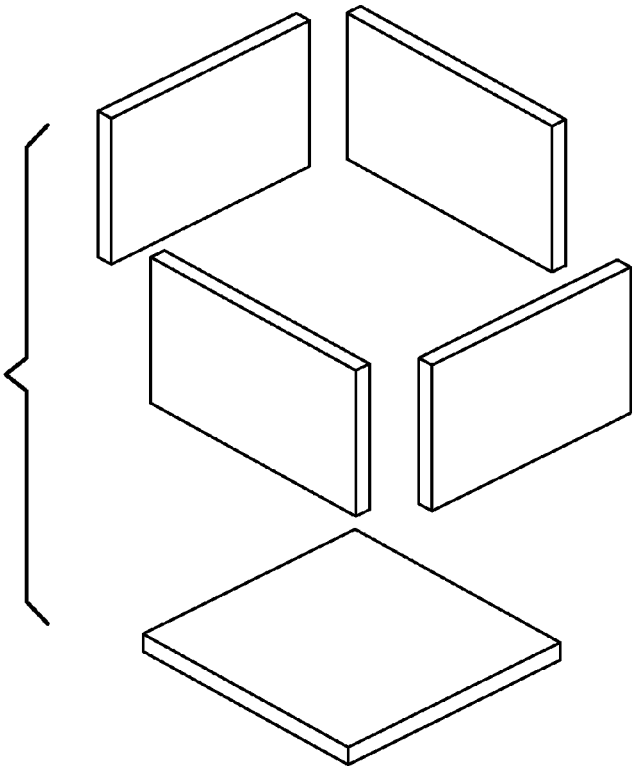

At step 404 and in view of FIG. 3B, metal plates are cut and/or machined to form the sides and/or the bottom of the die housing.

Figure 3C:
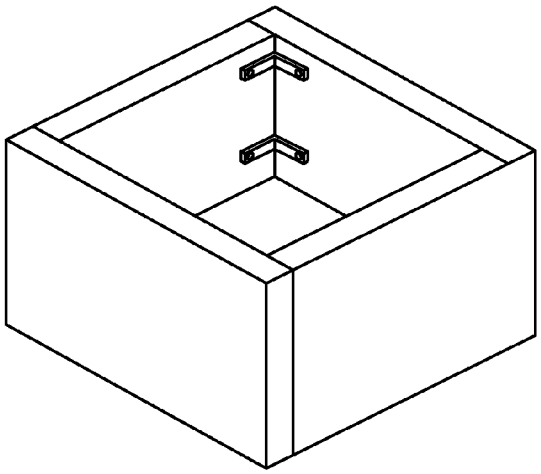

At step 406 and in view of FIG. 3C, holes may be drilled and tapped to assemble these plates to create the die housing. The assembly step may be assisted by the use of fasteners and/or welding.

Figure 2B:
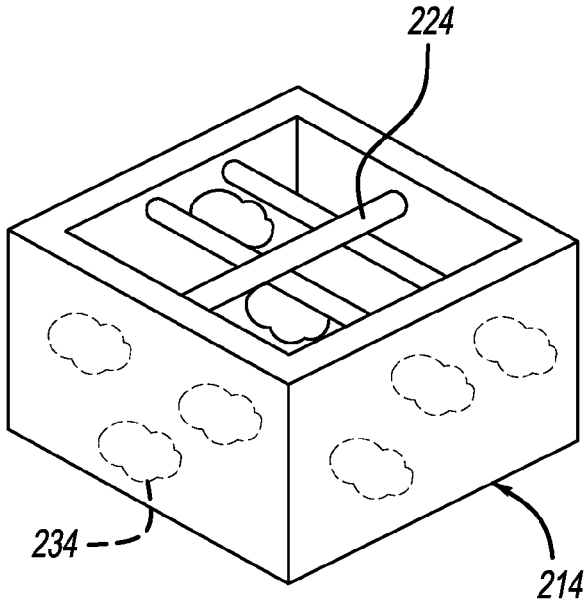
FIG. 2B illustratively depicts a partial view of the composite die referenced in FIG. 2A.
Figure 2C:
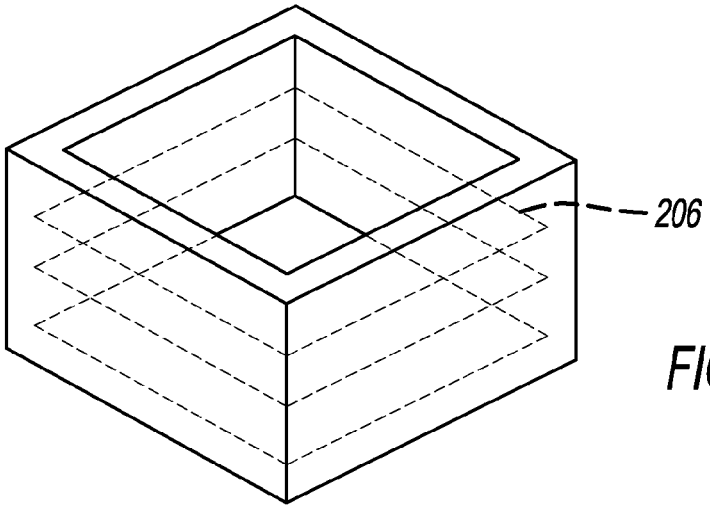
FIG. 2C illustratively depicts another partial view of the composite die referenced in FIG. 2A.
Figure 3D:
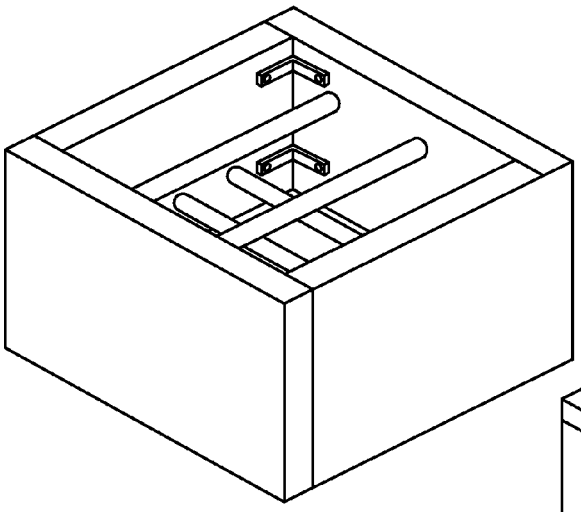

At step 408 and in view of FIG. 3D, certain reinforcement material such as the bridging member and the fillers referenced in FIG. 1B and FIG. 2B. may be added to the die housing to increase the overall die strength as well as the stiffness. This step may be particularly beneficial for medium and larger size dies.

Figure 3E:
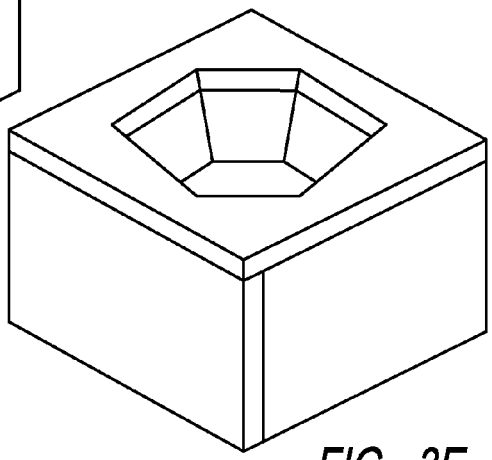

At step 410 and in view of FIG. 3E, the die face is then joined with the die housing via any suitable methods, including any suitable adhesives, TIG/MIG welding, brazing and/or reverts and screws.

Figure 3F:
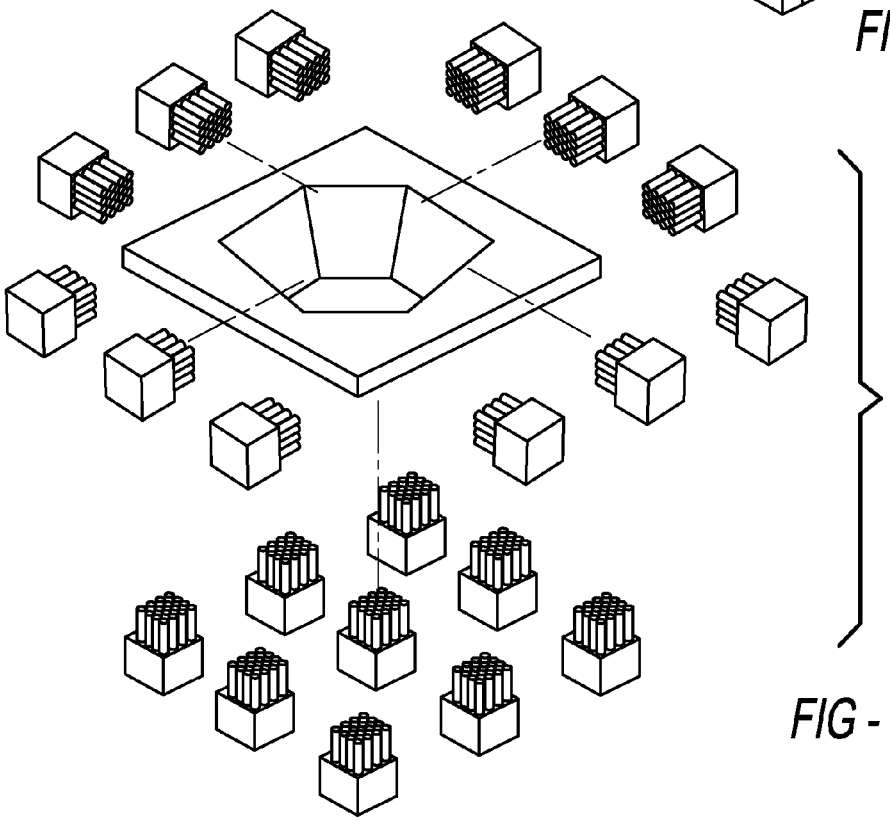
Figure 3G:
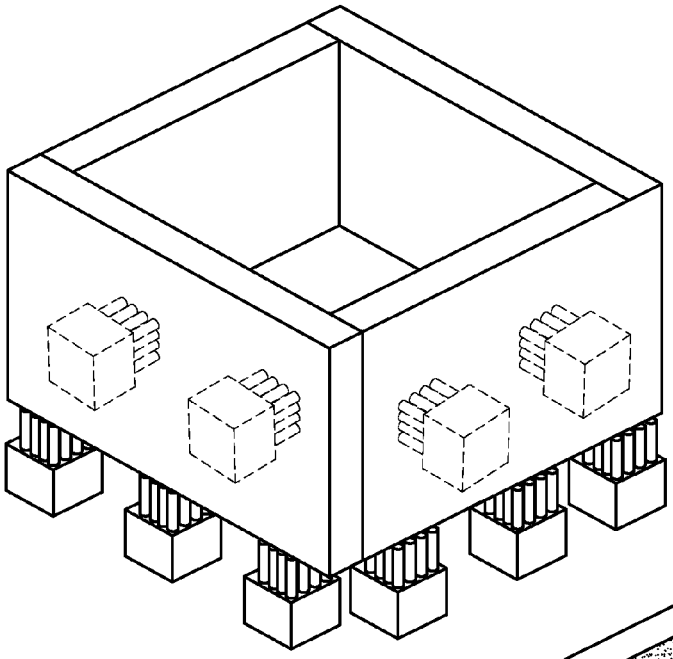

At step 412 and in view of FIG. 3F and FIG. 3G, a flexible fixture may be used to securely hold the die housing and support the weight of the resin filler on the die face while maintaining form tolerances. A typical flexible fixture can be constructed by assembling multiple pin beds. Alternatively, form machined to the same shape as the die face can be used instead of the pin bed assembly to support the loads on the die face. In this step, the die assembly is placed on the fixture, with the three-dimensional free form die face resting on the pin beds. Accordingly, the die housing may be supported and the sides of the die housing are secured.

Figure 3H:
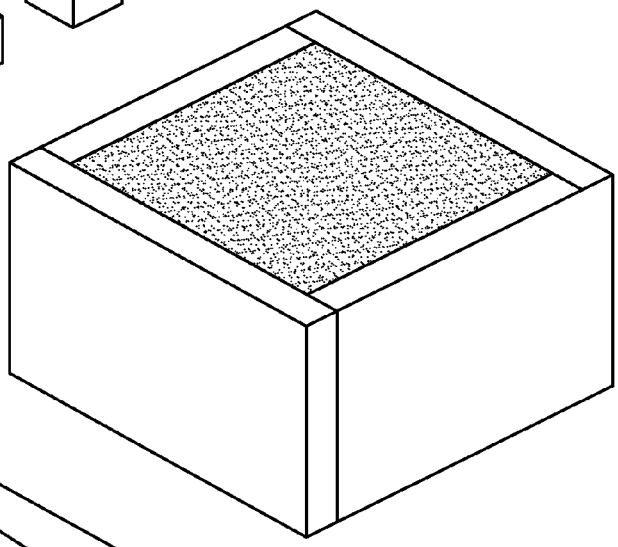

At step 414 and in view of FIG. 3H, a filler such as the fillers referenced in FIG. 1B and FIG. 2B is introduced into the die cavity. As stated herein elsewhere, the filler can be of any suitable material, with non-limiting examples thereof including high density epoxy with or without steel shots.

Figure 3I:
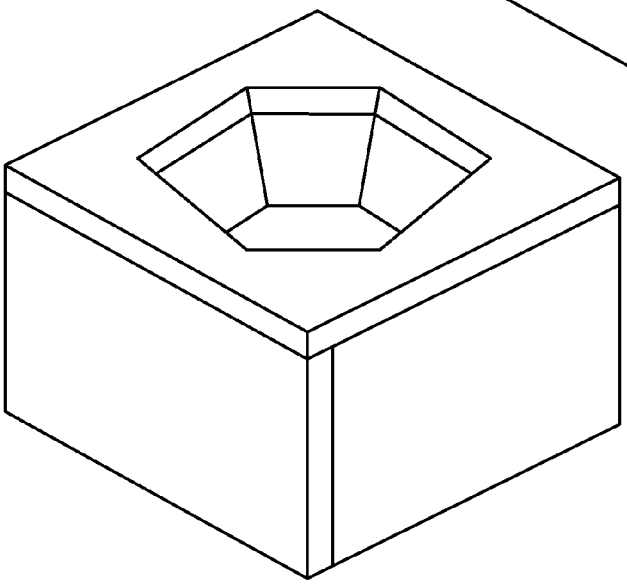
Figure 4:
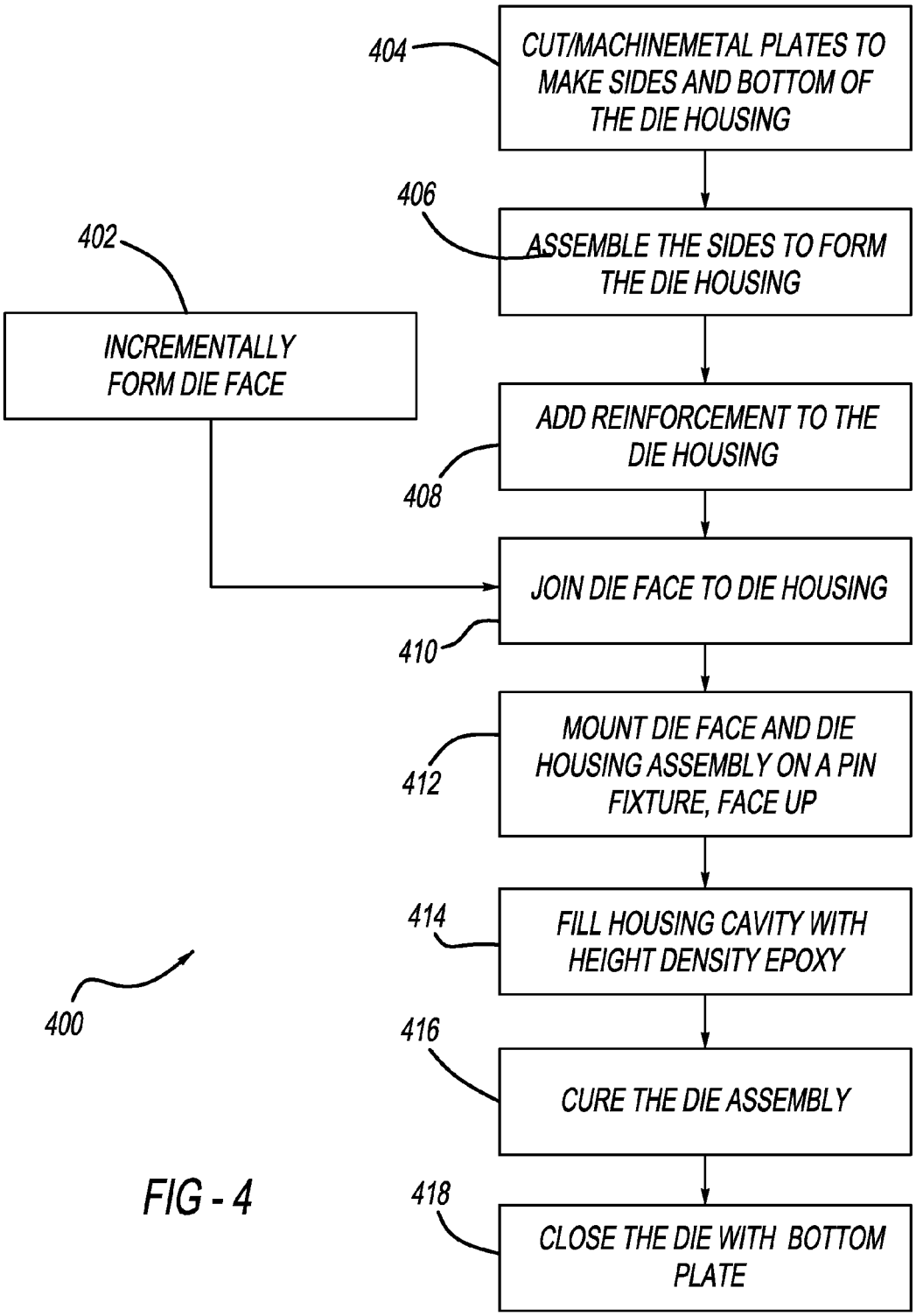
FIG. 4 illustratively depicts a block diagram of the process referenced in FIGS. 3A to 3I.

At steps 416 and 418, and further in view of FIG. 3I, the entire die assembly is cured and the bottom plate is secured onto the die housing to complete the formation of the die assembly.

Figure 5:
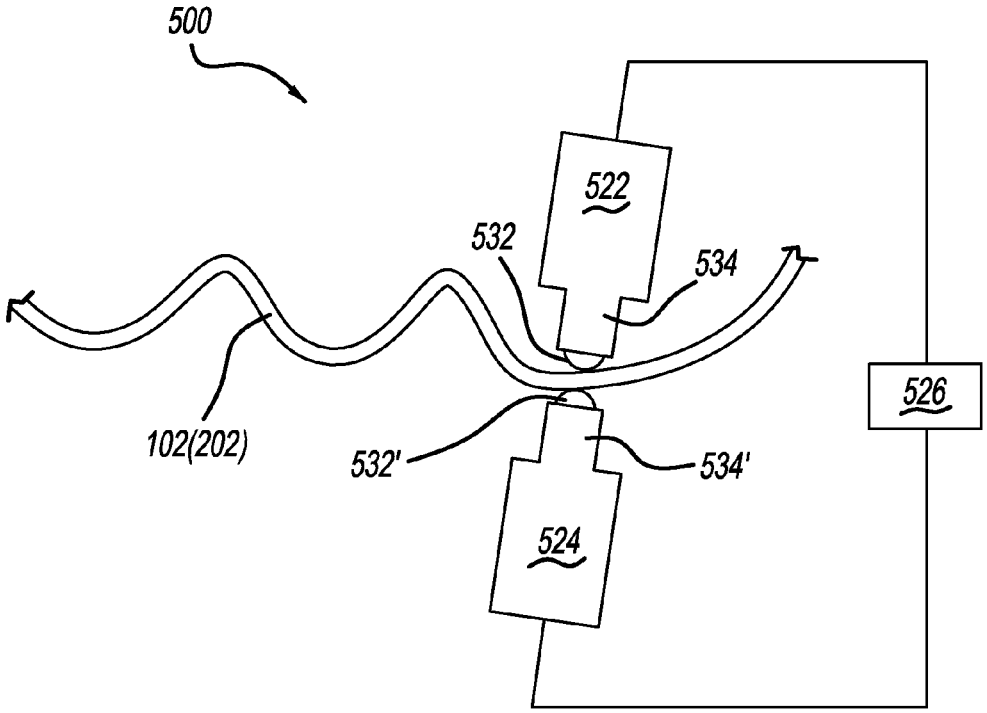
FIG. 5 illustratively depicts a non-limiting process of making a die face of the composite die referenced in FIG. 1A or FIG. 2A.

Referring back to FIG. 1A, FIG. 2A and FIG. 3A, the die face 102 (or 202) may be incrementally formed to define one or more protrusions such as protrusion 112*a*, 112*b*, via a system generally shown at 500 of FIG. 5. The die face thus formed may be referred to as a three-dimensional free form. As stated herein elsewhere, the die face 102 (or 202) may be made of any suitable material or materials that have desirable forming characteristics, such as a metal, metal alloy, polymeric material, or combinations thereof. In certain designs, the die face 102 (or 202) may be provided as sheet metal. The die face 102 (or 202) may be provided in an initial configuration that is generally planar or that is at least partially preformed into a non-planar configuration.

In incremental forming, the die face 102 (or 202) is formed into a desired configuration by a series of small incremental deformations. The small incremental deformations may be provided by moving one or more tools along or against one or more surfaces of the die face 102 (or 202). Tool movement may occur along a predetermined or programmed path. In addition, a tool movement path may be adaptively programmed in real-time based on measured feedback, such as from the load cell. Thus, incremental forming may occur in increments as at least one tool is moved and without removing material from the die face. More details of such a system 500 are described in U.S. Pat. No. 8,322,176 entitled "system and method for incrementally forming a workpiece" and issued on Dec. 4, 2012, which is incorporated by reference in its entirety. A brief summary of some components of the system 500 is provided below.

The system 500 may include a number of components that facilitate forming of the die face 102 (or 202), such as a first manipulator 522, a second manipulator 524, and a controller 526.

The manipulators 522, 524 may be provided to position first and second forming tools 532, 532'. The first and second manipulators 522, 524 may have multiple degrees of freedom, such as hexapod manipulators that may have at least six degrees of freedom. The manipulators 522, 524 may be configured to move an associated tool along a plurality of axes, such as axes extending in different orthogonal directions like X, Y and Z axes.

The forming tools 532, 532' may be received in first and second tool holders 534, 534', respectively. The first and second tool holders 534, 534' may be disposed on a spindle and may be configured to rotate about an associated axis of rotation in one or more embodiments.

The forming tools 532, 532' may impart force to form the die face 102 (or 202) without removing material. The forming tools 532, 532' may have any suitable geometry, including, but not limited to flat, curved, spherical, or conical shape or combinations thereof.

The one or more controllers 526 or control modules may be provided for controlling operation of the system 500. The controller 526 may be adapted receive computer assisted design (CAD) or coordinate data and provide computer numerical control (CNC) to form the die face 102 (or 202) to design specifications. In addition, the controller 526 may monitor and control operation of a measurement system that may be provided to monitor dimensional characteristics of the die face 102 (or 202) during the forming process.

In one or more embodiments, the disclosed invention as set forth herein overcomes the challenges faced by known production of metal dies tailored in the interest of obtaining cost and/or labor efficiencies for relatively low volume productions. However, one skilled in the art will readily recognize from such discussion, and from the accompanying drawings and claims that various changes, modifications and variations can be made therein without departing from the true spirit and fair scope of the invention as defined by the following claims.

What is claimed is:

1. A composite die comprising:

a die face defining first and second protrusions spaced apart from each other and including a first metal; and a die base supporting the die face, the die base including a housing with a second metal different than the first metal, a first filler positioned within the housing and supporting the first protrusion, a second filler different from the first filler in composition and supporting the second protrusion, and a bridging member reinforcing the housing.

2. The composite die of claim 1, further comprising a heat-conductive piping unit contacting the die base.

3. The composite die of claim 2, wherein the heat-conductive piping unit includes a conformal piping portion conforming to a corresponding shape of at least one of the die face and the die base.

4. The composite die of claim 1, wherein the first protrusion protrudes in a first direction and the second protrusion protrudes in a second direction different from the first direction.

5. The composite die of claim 1, wherein the die face includes a three-dimensional metallic free form produced by incremental forming.

6. The composite die of claim 1, wherein the first filler includes a third metal different than the first or the second metal.

7. The composite die of claim 1, wherein the housing includes a number of side walls and a floor joined to the number of side walls.

8. The composite die of claim 7, wherein at least two of the number of side walls differ from each other in dimension.

9. A composite die comprising:

a die face defining a protrusion and including a first metal;

a die base including a filler and a second metal and supporting the die face, the filler including a third metal different than the first or the second metal; and a heat-conductive piping unit contacting the die base.

10. The composite die of claim 9, wherein the heat-conductive piping unit includes a conformal piping portion conforming to a corresponding shape of at least one of the die face and the die base.

11. The composite die of claim 9, wherein the protrusion includes first and second protrusions spaced apart from each other.

12. The composite die of claim 11, wherein the first protrusion protrudes in a first direction and the second protrusion protrudes in a second direction different from the first direction.

13. The composite die of claim 12, wherein the filler includes a first filler supporting the first protrusion and a second filler supporting the second protrusion, the first filler being different than the second filler in composition.

14. The composite die of claim 9, further comprising a housing enclosing the filler, the housing including a number of side walls and a floor joined to the number of side walls.

15. The composite die of claim 14, wherein at least two of the number of side walls differ from each other in dimension.

16. A composite die comprising:

a die face defining first and second protrusions spaced apart from each other;

a die base including a filler and supporting the die face; and a heat-conductive piping unit contacting the die base.

17. The composite die of claim 16, wherein the first protrusion protrudes in a first direction and the second protrusion protrudes in a second direction different from the first direction.

18. The composite die of claim 16, wherein the filler includes a first filler supporting the first protrusion and a second filler supporting the second protrusion, the first filler being different than the second filler in composition.

* * * * *